US008763859B2

(12) United States Patent
Cain

(10) Patent No.: US 8,763,859 B2
(45) Date of Patent: Jul. 1, 2014

(54) SQUEEZE TUBE

(75) Inventor: Tony Cain, Spottsville, KY (US)

(73) Assignee: Berry Plastics Corporation, Evansville, IN (US)

( * ) Notice: Subject to any disclaimer, the term of this patent is extended or adjusted under 35 U.S.C. 154(b) by 47 days.

(21) Appl. No.: 13/368,203

(22) Filed: Feb. 7, 2012

(65) Prior Publication Data

US 2012/0199610 A1 Aug. 9, 2012

Related U.S. Application Data

(60) Provisional application No. 61/440,287, filed on Feb. 7, 2011.

(51) Int. Cl.
*B65D 35/00* (2006.01)

(52) U.S. Cl.
USPC ..... 222/107; 222/546; 222/213; 222/212; 222/462

(58) Field of Classification Search
CPC ..... B65D 1/0215; B65D 35/08; B65D 35/44; B65D 47/2031
USPC ..... 222/212–215, 556, 107; 215/344, 12.2
See application file for complete search history.

(56) References Cited

U.S. PATENT DOCUMENTS 2,906,462 A * 9/1959 West ..... 239/337
3,451,597 A * 6/1969 Watson, Jr. ..... 222/207
3,972,435 A * 8/1976 Sasaki et al. ..... 215/12.2
4,065,589 A * 12/1977 Lenard et al. ..... 428/34.7
4,261,482 A * 4/1981 Yamada et al. ..... 222/215
4,407,421 A * 10/1983 Waugh ..... 215/12.2
4,646,925 A * 3/1987 Nohara ..... 428/542.8
4,685,591 A * 8/1987 Schaefer et al. ..... 222/107
4,910,054 A * 3/1990 Collette et al. ..... 428/35.7
5,547,091 A * 8/1996 Neveras et al. ..... 215/237
5,640,998 A * 6/1997 Schneider et al. ..... 138/89
6,550,646 B1 * 4/2003 Takahara et al. ..... 222/107
6,557,728 B1 * 5/2003 Anderson et al. ..... 222/39
7,807,270 B2 * 10/2010 Share et al. ..... 428/474.4
2002/0014501 A1 * 2/2002 Nyman et al. ..... 222/498
2009/0065528 A1 * 3/2009 Bray ..... 222/107
2012/0312840 A1 * 12/2012 Hasegawa et al. ..... 222/215

FOREIGN PATENT DOCUMENTS

DE 20311719 1/2005

* cited by examiner

*Primary Examiner* — Paul R Durand
*Assistant Examiner* — Jeremy W Carroll
(74) *Attorney, Agent, or Firm* — Barnes & Thornburg LLP

(57) ABSTRACT

A tube is configured to store and discharge fluid materials. The tube includes a container and a closure formed to include a fluid-discharge port and coupled to the container to place the fluid-discharge port in communication with any fluid stored in an interior region formed in the container. In illustrative embodiments, the closure includes a base coupled to the container and formed to include the fluid-discharge port, a flip-top cap, and a hinge arranged to interconnect the base and the flip-top cap.

22 Claims, 5 Drawing Sheets

SQUEEZE TUBE

PRIORITY CLAIM

This application claims priority under 35 U.S.C. §119(e) to U.S. Provisional Application Ser. No. 61/440,287, filed Feb. 7, 2011, which is expressly incorporated by reference herein.

BACKGROUND

The present disclosure relates to tubes, and particularly to tubes for storing and discharging fluid materials. More particularly, the present disclosure relates to a squeeze tube comprising a fluid-storage container and a fluid-dispensing closure coupled to the fluid-storage container.

SUMMARY

A squeeze tube in accordance with the present disclosure includes a squeezable fluid-storage container and a fluid-dispensing closure mated to the fluid-storage container. The fluid-dispensing closure is coupled to one end of the fluid-storage container and configured to control discharge of fluid stored in the fluid-storage container through a discharge aperture formed in the fluid-dispensing closure.

In illustrative embodiments, the fluid-dispensing closure includes a base having a ring, a fluid-discharge deck formed to include the discharge aperture, and a generally cone-shaped nozzle interposed between and coupled to the ring and the fluid-discharge deck. The cone-shaped nozzle includes an upper portion coupled to the fluid-discharge deck and a lower portion interposed between and coupled to the upper portion and the ring. The lower portion of the cone-shaped nozzle is formed to provide a recessed channel extending about the circumference of the lower portion.

In illustrative embodiments, an upper end of the fluid-storage container provides a tubular closure-mount sleeve that lies in a stationary and fixed position in the recessed channel formed in the lower portion of the cone-shaped nozzle in the base of the fluid-dispensing closure to support a tubular receptacle coupled to the tubular closure-mount sleeve below the fluid-dispensing closure. The fluid-dispensing closure includes a base formed to include a discharge aperture opening into an interior region bounded by the tubular closure-mount sleeve and the tubular receptacle and, in illustrative embodiments, a flip-top cap and a hinge for supporting the flip-top cap for movement relative to the base between opened and closed positions.

In illustrative embodiments, the tubular closure-mount sleeve of the fluid-storage container is nested in the recessed channel formed in the base of the fluid-dispensing closure. The result is that an exterior surface of a visible upper portion of the cone-shaped nozzle is arranged to mate and merge in smooth alignment with an abutting outer surface of the tubular closure-mount sleeve at an annular junction established between those exterior and outer surfaces to provide substantially smooth and continuous outside wall of the squeeze tube at the annular junction. In other words, a top rim and a fluid-discharge deck included in the fluid-dispensing closure are visible and located outside of the fluid-storage container while a bottom rim of the fluid-dispensing closure is hidden and located inside the fluid-storage container and is configured to cause the exterior surface of the top rim and the outer surface of the tubular closure-mount sleeve to mate end-to-end in smooth alignment with one another to provide the squeeze tube with a substantially smooth and continuous outer wall around a circumference of the squeeze tube.

In illustrative embodiments, the fluid-storage container comprises a tubular sleeve made of a multi-layer sheet. The sheet comprises an inner tubular layer, an outer tubular layer, and a middle tubular layer interposed between and coupled to the inner and outer tubular layers.

An upper portion of the inner tubular layer includes a bottom section that has an interior surface that mates with an exterior surface of the ring and a top section that is coupled to a top perimeter edge of the bottom section and is arranged to extend upwardly therefrom. The top section extends into the recessed channel to mate with a portion of the lower portion of the cone-shaped nozzle defining a floor of the recessed channel. The outer tubular layer extends through and lies in the recessed channel formed in the lower portion of the cone-shaped nozzle to cause an exterior surface of the upper portion of the cone-shaped nozzle to mate in smooth alignment with an exterior surface of the outer tubular layer to provide a substantially smooth and continuous exterior wall of the squeeze tube around the circumference of the squeeze tube at the junction between the fluid-dispensing closure and the fluid-discharge tube.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
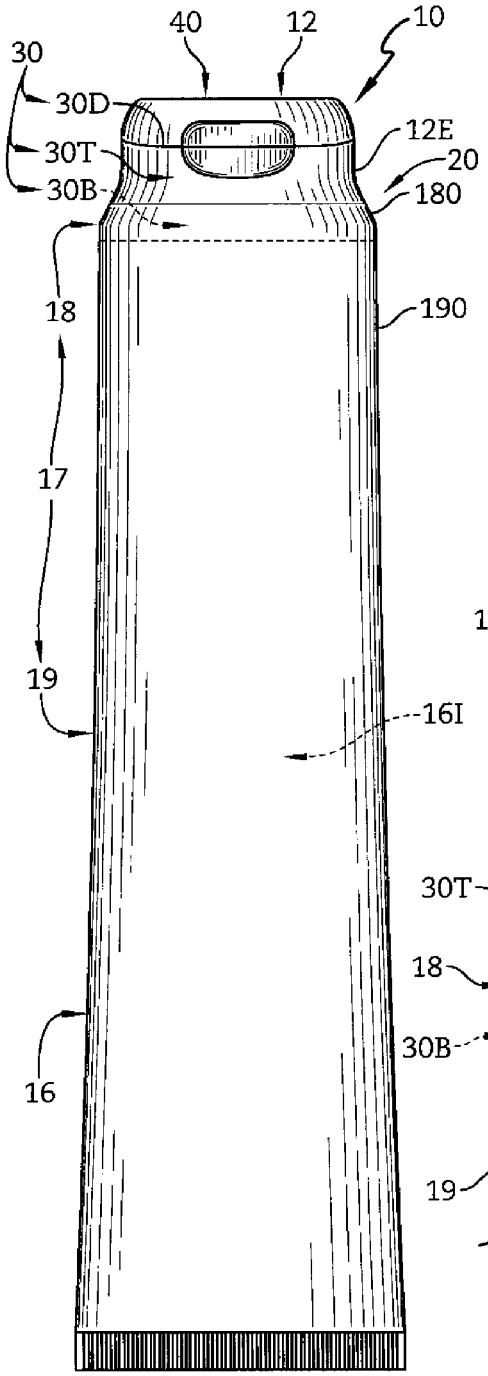
FIG. 1 is a front elevation view of a squeeze tube in accordance with the present disclosure showing an elongated squeezable fluid-storage container formed to include an interior region and showing that the squeezable fluid-storage container is coupled to a lower portion of a fluid-dispensing closure and provided with a tubular upper end that is arranged to surround and cover that lower portion.
Figure 2:
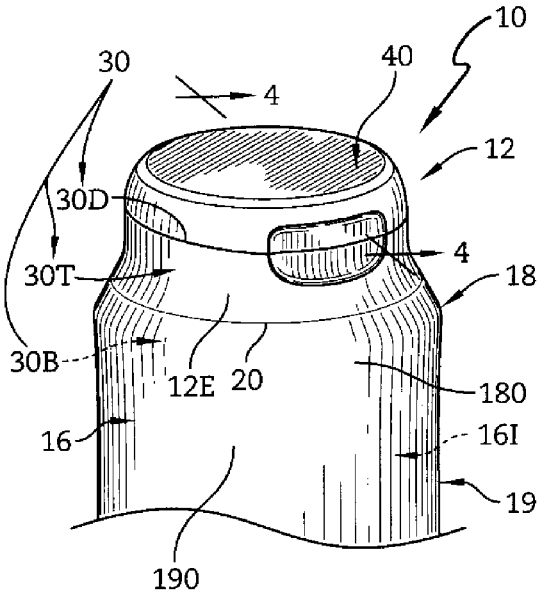
FIG. 2 is an enlarged perspective top view of a portion of the squeeze tube of FIG. 1 showing a flip-top cap included in the fluid-discharge closure of the squeeze tube in a closed position.
Figure 3:
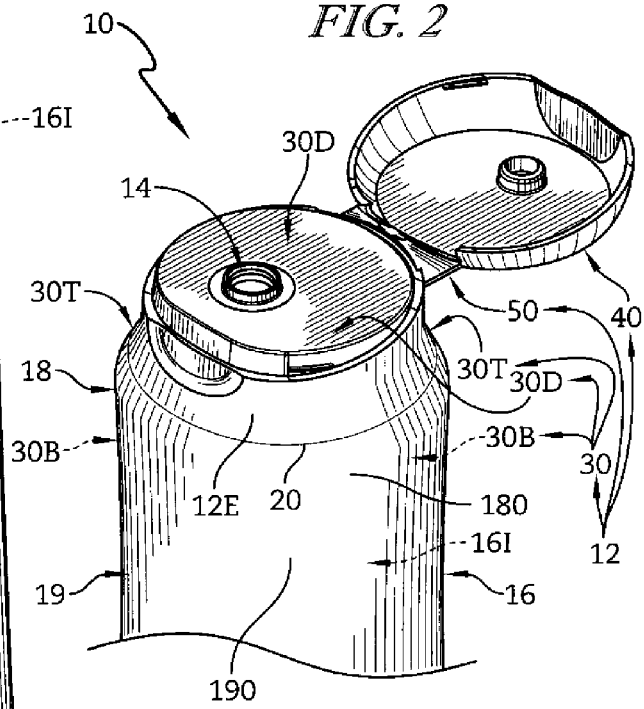
FIG. 3 is a view similar to FIG. 3 showing the flip-top cap after the flip-top cap has been moved to an opened position to expose a discharge aperture formed in a base of the fluid-discharge closure and suggesting that the base provides the lower portion of the fluid-dispensing closure that is surrounded and covered by the tubular upper end of the squeezable fluid-storage container.

A squeeze tube 10 in accordance with the present disclosure is shown, for example, in FIGS. 1-3. Squeeze tube 10 includes a fluid-dispensing closure 11 having a base 30 that is formed to include a discharge aperture 14 as suggested in FIG. 3. Squeeze tube 10 also includes a fluid-storage container 16 having a tubular upper end that surrounds and mates with only a bottom rim 30B of the base 30 that is included in fluid-dispensing closure 12 to cause discharge aperture 14 of fluid-dispensing closure 12 to open into an interior region 16I formed in fluid-storage container 16 as suggested in FIGS. 4 and 5. Fluid-storage container 16 also includes a tubular receptacle 19 that is closed at a lower end and coupled at an upper end to tubular closure-mount sleeve 18 to form interior region 16I as suggested in FIG. 1.

Figure 4:
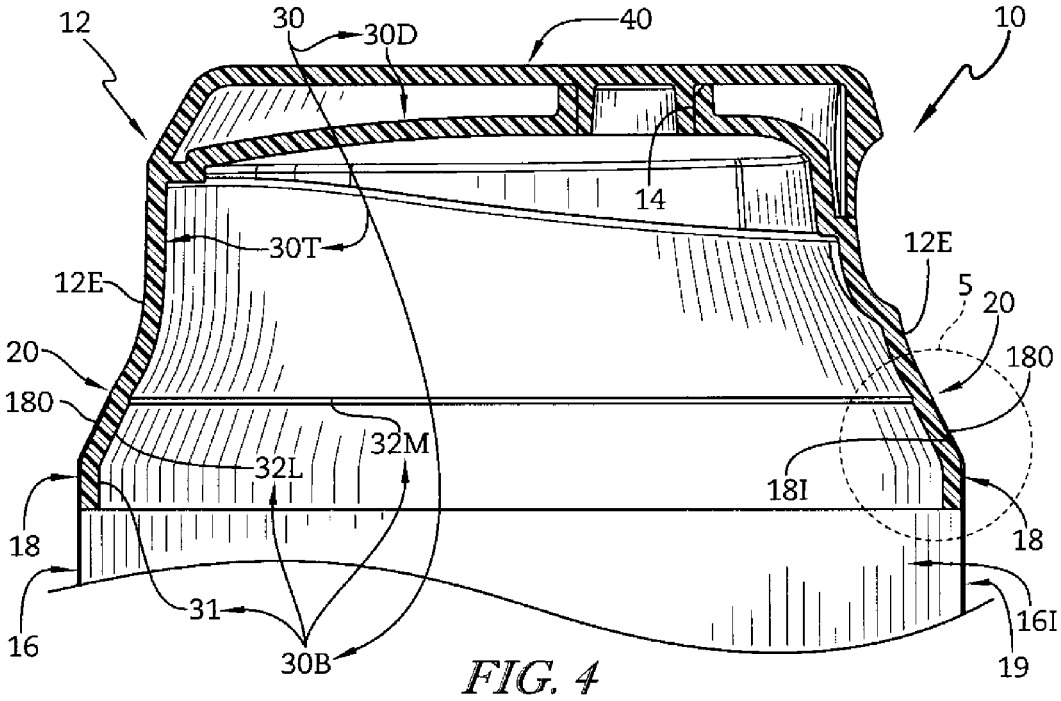
FIG. 4 is an enlarged sectional view of a portion of the squeeze tube taken along line 4-4 of FIG. 3 showing that the base of the fluid-discharge closure includes a generally cone-shaped nozzle and an underlying cylinder-shaped ring and the squeezable fluid-storage container includes (1) a tubular closure-mount sleeve coupled to and arranged to surround and cover the cylinder-shaped ring and a lower portion of the generally cone-shaped nozzle and (2) a thin-walled tubular receptacle coupled to the tubular closure-mount sleeve and arranged to extend downwardly therefrom to provide most of the interior region of the squeezable fluid-storage container.
Figure 5:
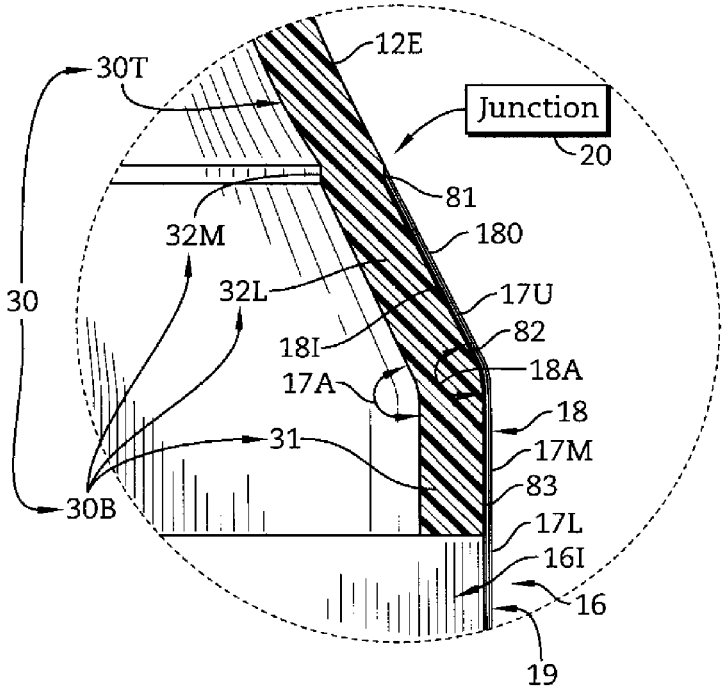
FIG. 5 is an enlarged view taken from the circled region of FIG. 4 showing that the cylinder-shaped ring and a lower portion of the generally cone-shaped nozzle included in the base of the fluid-dispensing closure is positioned to lie in the interior region formed in the squeezable fluid-storage container and also showing that an outer surface of the tubular closure-mount sleeve of the squeezable fluid-storage container is arranged to mate and merge in smooth alignment with an overlying exposed exterior surface of the upper portion of the generally cone-shaped nozzle of the base of the fluid-discharge closure to provide a substantially smooth and continuous outside wall of the squeeze tube around a circumference of the squeeze tube at a junction between the fluid-dispensing closure and the upper end of the squeezable fluid-storage container.

An exterior surface 12E of a top rim 30T included in base 30 of fluid-dispensing closure 12 is arranged as shown in FIG. 5 to mate and merge in smooth alignment with an outer surface 18O of tubular upper end of fluid-storage container 16 to provide a substantially smooth and continuous outside wall of squeeze tube 10 at a junction 20 between top rim 30T of base 30 of fluid-dispensing closure 12 and tubular upper end of fluid-storage container 16 as shown, for example, in FIGS. 1-3. Tubular upper end is configured to define a tubular closure-mount sleeve 18 that is adapted to mate with and surround bottom rim 30B of fluid-dispensing closure 12 as suggested in FIGS. 1, 4, and 5.

As suggested in FIGS. 1, 4, and 5, top rim 30T of base 30 of fluid-dispensing closure 12 is exposed and visible while the underlying bottom rim 30B of fluid-dispensing closure 12 is surrounded and covered by the tubular upper end (e.g., closure-mount sleeve 18) of fluid-storage container 16 and thus hidden from view once fluid-storage container 16 is coupled to bottom rim 30B of base 30. In an illustrative embodiment, base 30 includes a fluid-discharge deck 30D formed to include discharge aperture 14, a bottom rim 30B coupled to tubular upper end of fluid-storage container 16 and arranged to lie in interior region 16I of fluid-storage container 16, and a visible and exposed top rim 30T arranged to interconnect the overlying fluid-discharge deck 30D and the underlying bottom rim 30B as shown in FIG. 4.

An illustrative coupling process is shown, for example, in FIGS. 6-10. Once the coupling process has been completed to mount fluid-storage container 10 on bottom rim 30B of base 30 of fluid-dispensing closure 12, a smooth visible outside interface is established at the annular junction 20 provided between neighboring and abutting portions of the top rim 30B of base 30 of fluid-dispensing closure 12 and the tubular upper end (e.g., closure-mount sleeve 18) of fluid-storage container to 16 as suggested in FIGS. 5, 10, and 12.

Bottom rim 30B of base 30 of fluid-dispensing closure 12 includes a first annular section 31, a second annular section 32L located above and coupled to first annular section 31, and a third annular section 32M located above and coupled to second annular section 32L as shown, for example, in FIG. 5. First annular section 31 is cylinder-shaped and each of second and third annular sections 32L, 32M has a frustoconical shape in an illustrative embodiment shown in FIG. 6.

Top rim 30T of base 30 of fluid-dispensing closure 12 is located above and coupled to third annular section 32M as shown, for example, in FIGS. 4 and 5. Fluid-discharge deck 30D of base 30 is coupled to a top edge of top rim 30T and formed to include discharge aperture 14 as suggested in FIG. 3.

Tubular upper end of fluid-storage container 16 is arranged to surround and mate with exterior surfaces 83, 82, and 81 of first, second, and third annular sections 31, 32L, and 32M of bottom rim 30B of base 30 in an illustrative embodiment so that an outer surface 12E of top rim 30T of base 30 is visible and exposed to a consumer handling squeeze tube 10 as suggested in FIGS. 1-5. A substantially smooth and continuous outside wall of squeeze tube 10 is formed around a circumference of squeeze tube 10 at the junction 20 between top rim 30T of base 30 of fluid-dispensing closure 12 and an outer surface 18O of tubular upper end of fluid-storage container 16 as suggested in FIGS. 1-5.

Fluid-dispensing closure 12 is coupled to the tubular upper end of fluid-storage container 16 as shown, for example, in FIGS. 4 and 5. In an illustrative embodiment, fluid-dispensing closure 12 includes a base 30 adapted to mate with tubular upper end of fluid-storage container 16, a flip-top cap 40, and a hinge 50 for supporting flip-top cap 40 for pivotable movement between a closed position closing discharge aperture 14 shown in FIG. 2 and an opened position opening discharge aperture 14 shown in FIG. 3. Fluid-dispensing closure 12 is configured to control discharge of fluid stored in an interior region 16I of the squeezable fluid-storage container 16 through a discharge aperture 14 formed in fluid-discharge deck 30D of base 30.

Base 30 of fluid-dispensing closure 12 can also be described to include a ring 31, a generally cone-shaped nozzle 32, and a fluid-discharge deck 30D. Ring 31 is located inside interior region 16I of the squeezable fluid-storage container 16. Fluid-discharge deck 30D is located outside interior region 16I of the squeezable fluid-storage container 16 and formed to include discharge aperture 14.

Figure 6:
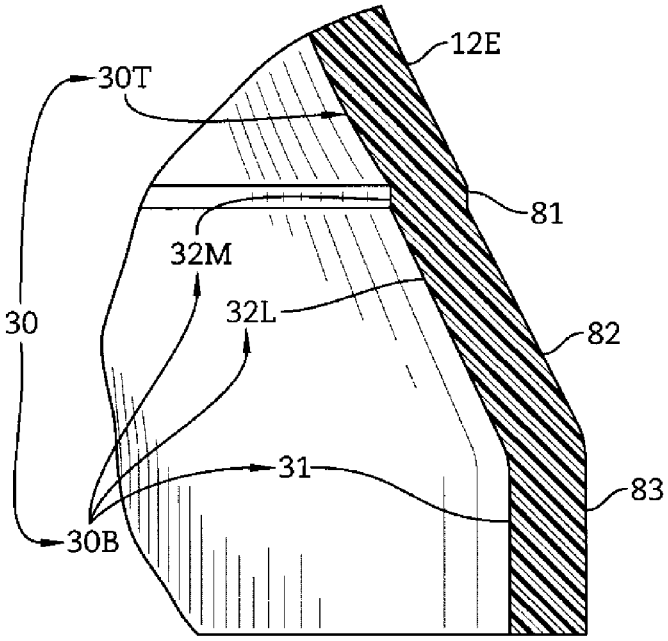
FIG. 6 is an enlarged view of the portion of the base of the fluid-discharge closure shown in FIG. 5 before the upper end of the fluid-storage container is coupled to the base of the fluid-dispensing closure as suggested, for example, in FIGS. 7-9 and showing (from bottom to top) the ring and lower, middle, and upper portions of the generally cone-shaped nozzle and showing that the middle portion is formed to include an exposed annular lip arranged to lie between exterior surfaces of the upper and lower portions.

Cone-shaped nozzle 32 includes upper, middle, and lower portions 32U, 32M, and 32L as shown, for example, in FIGS. 4-6. Ring 31 and lower and middle portions 32L, 32M of cone-shaped nozzle 32 cooperate to define bottom rim 30B of base 30. Upper portion 32U of cone-shaped nozzle 32 defines top rim 30T of base 30.

Upper portion 32U (30T) of cone-shaped nozzle 32 is coupled to fluid-discharge deck 30D and located outside of interior region 16I of fluid-storage container 16 as shown, for example, in FIGS. 1-4. Lower portion 32L of cone-shaped nozzle 32 is coupled to ring 31 and located inside interior region 16I of fluid-storage container 16. Middle portion 32M of cone-shaped nozzle 32 is interposed between and coupled to each of upper and lower portions 32U, 32L and located inside interior region 16I of fluid-storage container 16 as shown, for example, in FIGS. 4 and 5. Middle portion 32M of cone-shaped nozzle 32 is formed to include an exposed annular lip 81 arranged to lie between exterior surfaces 12E, 82 of upper and lower portions 32U, 32L of cone-shaped nozzle 32 as shown, for example, in FIG. 6. Exposed annular lip 81 is arranged to cooperate with exterior surface 82 of lower portion 32L of cone-shaped nozzle 32 to form an obtuse included angle 81A therebetween as shown, for example, in FIG. 6, in part, to provide a large annular space for receiving fluidized annular tip 18T during a heating step as suggested in FIG. 9. Exposed annular lip 81 has a frustoconical shape in an illustrative embodiment as suggested in FIG. 6.

Tubular upper end of fluid-storage container 16 is configured to define a tubular closure-mount sleeve 18 as suggested in FIGS. 4 and 5. Tubular closure-mount sleeve 18 includes (1) an inner surface 18I arranged to mate with exterior surface 82 of lower portion 32L of cone-shaped nozzle 32 and exterior surface 83 of ring 31, (2) an outer surface 18O arranged to face away from exterior surface 82 of lower portion 32L of cone-shaped nozzle 32 and exterior surface 83 of ring 31, and (3) an annular tip 18T arranged to interconnect inner and outer surfaces 18I, 18O of tubular closure-mount sleeve 18. Annular tip 18T is arranged to mate with the exposed annular lip 81 of cone-shaped nozzle 32 to cause outer surface 18O of tubular closure-mount sleeve 18 to mate and merge in smooth alignment with an abutting exterior surface 12E of upper portion 32U of cone-shaped nozzle 32 included in base 30 to provide a substantially smooth and continuous outside wall of squeeze tube 10 around a circumference of squeeze tube 10 at an annular junction 20 between fluid-dispensing closure 12 and tubular closure-mount sleeve 18 of fluid-storage container 16.

Receptacle 19 of fluid-storage container 16 is formed to define part of interior region 16I of fluid-storage container 16 as suggested in FIG. 4. Receptacle 19 is coupled to tubular closure-mount sleeve 18 to depend therefrom without providing any visible outer gap between an exterior surface 83 of ring 31 of fluid-dispensing closure 12 and an outer surface 18O of tubular closure-mount sleeve 18 of fluid-storage container 16 as suggested in FIGS. 1, 4, and 5.

Base 30 of fluid-discharge closure 12 includes a generally cone-shaped nozzle 32 and an underlying cylinder-shaped ring 31 as suggested in FIGS. 4 and 5. Squeezable fluid-storage container 16 includes (1) a tubular closure-mount sleeve 18 coupled to and arranged to surround and cover the cylinder-shaped ring 31 and a lower portion 30L of the generally cone-shaped nozzle 32 and (2) a thin-walled tubular receptacle 19 coupled to tubular closure-mount sleeve 18 and arranged to extend downwardly therefrom to provide most of interior region 16I of the squeezable fluid-storage container 16 as suggested in FIGS. 1-5.

Cylinder-shaped ring 31 and a lower portion 32L of generally cone-shaped nozzle 32 included in base 30 of fluid-dispensing closure 12 is positioned to lie in interior region 16I formed in the squeezable fluid-storage container 16. An outer surface 18O of tubular closure-mount sleeve 18 of fluid-storage container 16 is arranged to mate and merge in smooth alignment with an overlying and abutting exposed exterior surface 12E of upper portion 32U of the generally cone-shaped nozzle 32 of base 30 of fluid-discharge closure 12 to provide a substantially smooth and continuous outside wall of squeeze tube 10 around a circumference of squeeze tube 10 at an annular junction 20 between fluid-dispensing closure 12 and tubular upper end of the squeezable fluid-storage container 16.

Outer surfaces 18O, 19O of tubular closure-mount sleeve 18 and receptacle 19 cooperate to define an uninterrupted skin devoid of visible gaps therebetween as suggested in FIGS. 1-3. A single tubular band 17 is formed to define tubular closure-mount sleeve 18 and receptacle 19. Singular tubular band 17 includes an upper section 17U arranged to mate with the exposed annular lip 81 and the exterior surface 82 of lower portion 32L of cone-shaped nozzle 32 and a middle section 17M arranged to mate with the exterior surface 83 of ring 31 as suggested in FIG. 5. A lower section 17L of singular tubular band 17 is arranged to extend downwardly away from ring 31 as suggested in FIG. 5. Upper section 17U is substantially cone-shaped. Middle section 17M is substantially cylinder-shaped. Outer surfaces of the upper and middle sections of the singular tubular band 17 cooperate to define an obtuse included angle 17A therebetween as shown, for example, in FIG. 5. Exterior surface 12E of upper portion 32U of cone-shaped nozzle 32L of fluid-dispensing closure 12 cooperates with the outer surfaces 18O of the upper and middle sections 17U, 17M of the single tubular band 17 to provide a substantially smooth and continuous outside wall of squeeze tube 10 around the circumference of squeeze tube 10 at the annular junction 20 between fluid-dispensing closure 12 and fluid-storage container 16.

Tubular closure-mount sleeve 18 includes a top part 17U and a bottom part 17M as suggested in FIG. 5. Top part 17U has an end surface 18T arranged to mate with the exposed annular lip 81 of cone-shaped nozzle 32 and an inner surface 18I arranged to mate with upper portion 32U of cone-shaped nozzle 32. Bottom part 17M has an inner surface 18I arranged to mate with lower portion 32L of cone-shaped nozzle 32. Top and bottom parts 17U, 17M of tubular closure-mount sleeve 18 cooperate to define an obtuse included angle 18A therebetween as suggested in FIG. 5.

Figure 9:
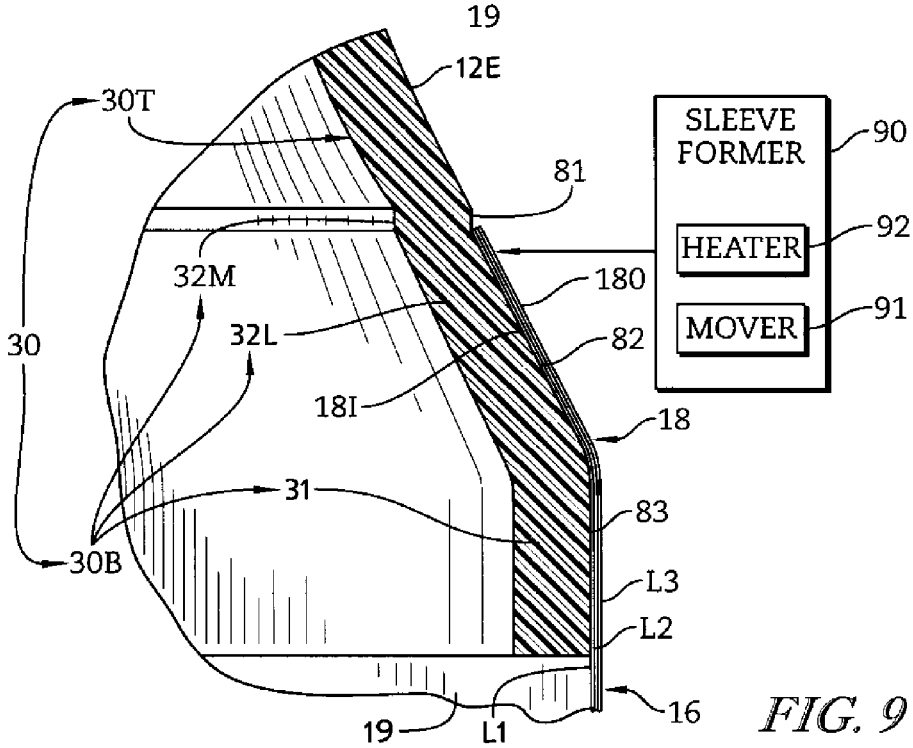
FIG. 9 is a view similar to FIGS. 7 and 8 showing a third assembly step in accordance with the present disclosure in which heat is applied to the top part of the tubular closure-mount sleeve by a heater included in the sleeve former after an inner surface of the top part mates with the exterior surface of the lower portion of the generally cone-shaped nozzle to fluidize an annular tip of the tubular closure-mount sleeve.
Figure 11:
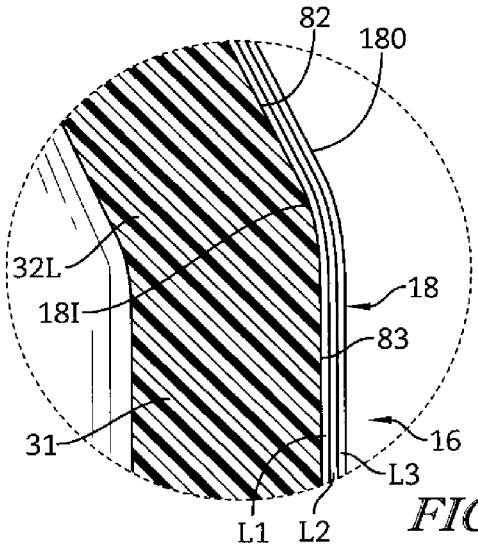
FIG. 11 is an enlarged sectional view of a portion of the squeeze tube taken from a first circled region of FIG. 10.

Tubular closure-mount sleeve 18 of fluid-storage container 16 comprises a multi-layer sheet including an inner tubular layer L1, an outer tubular layer L3, and a middle tubular layer L2 interposed between and coupled to inner and outer tubular layers L1, L3 in an illustrative embodiment as suggested in FIGS. 9 and 11. Inner tubular layer L1 includes the inner surface that is arranged to mate with the exterior surfaces 82, 83 of ring 31 and lower portion 32L of cone-shaped nozzle 32 of fluid-dispensing closure 12. Outer tubular layer L3 includes the outer surface that is arranged to mate and merge in smooth alignment with exterior surface 12E of upper portion 32U of cone-shaped nozzle 32 of fluid-dispensing closure 12. It is within the scope of this disclosure to form tubular closure-mount sleeve 18 from a single sheet or from any suitable number of material layers.

Exposed ends of each of inner, middle, and outer tubular layers L1, L2, L3 of tubular closure-mount sleeve 18 cooperate to define the tip 18T of tubular closure-mount sleeve 18 and mate with the exposed annular lip 81 of fluid-storage container 16. Each of the exposed ends of the inner, middle, and outer tubular layers L1, L2, L3 has a frustoconical shape when mated with the exposed annular lip 81.

Figure 7:
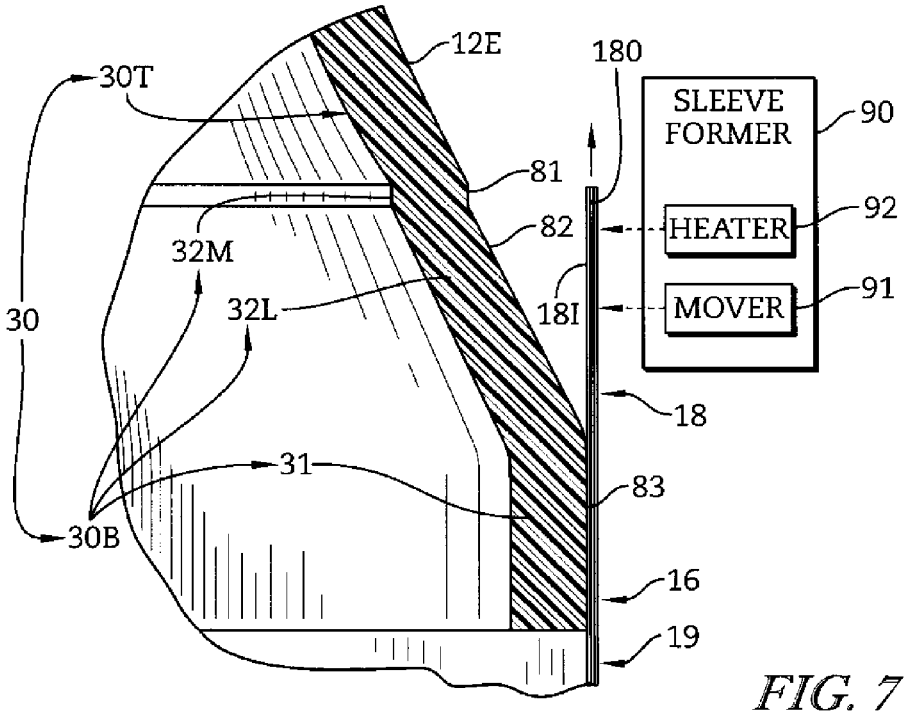
FIG. 7 is a view similar to FIG. 6 showing a first assembly step in accordance with the present disclosure in which a tubular closure-mount sleeve included in the fluid-storage container is moved upwardly by a sleeve former (shown diagrammatically) to cause an inner surface of a bottom part of the tubular closure-mount sleeve to mate with the exterior surface of the ring included in the base of the fluid-dispensing closure.
Figure 8:
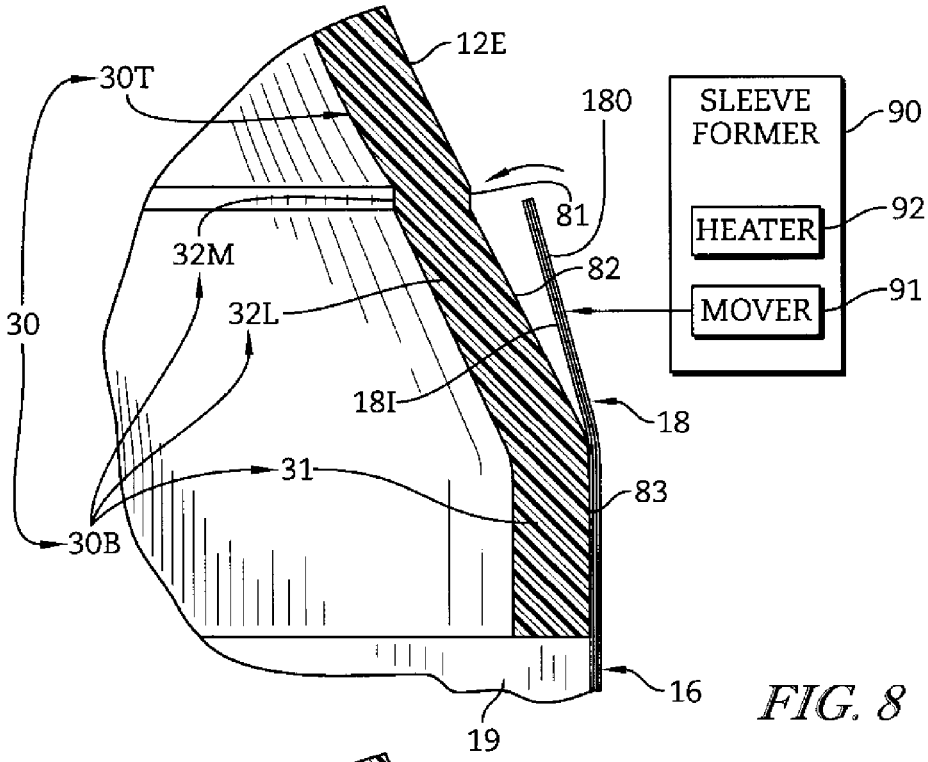
FIG. 8 is a view similar to FIG. 7 showing a second assembly step in accordance with the present disclosure in which a top part of the tubular closure-mount sleeve is moved towards the generally cone-shaped nozzle included in the base of the fluid-dispensing closure by a mover included in the sleeve former.

As suggested in FIG. 6, the base 30 of fluid-discharge closure 12 is shown before upper end (e.g., tubular closure-mount sleeve) 18 of fluid-storage container 16 is coupled to base 30 of fluid-dispensing closure 12 as suggested, for example, in FIGS. 7-9. The ring 31 and lower, middle, and upper portions 32L, 32M, 32U of the generally cone-shaped nozzle 32 of base 30 are shown before fluid-storage container 16 is coupled to base 30. Middle portion 32M is formed to include an exposed annular lip 81 that is arranged to lie between exterior surfaces 12E, 82 of upper and lower portions 32U, 32L.

A first assembly step in accordance with the present disclosure is shown in which a tubular closure-mount sleeve 18 of fluid-storage container 16 is moved upwardly by a sleeve former 90 (shown diagrammatically) to cause an inner surface 18I of a bottom part 17M of tubular closure-mount sleeve 18 to mate with the exterior surface 83 of ring 31 included in base 30 of fluid-dispensing closure 12. A second assembly step is shown in FIG. 8 in which a top part 17U of the tubular closure-mount sleeve 18 is moved towards the generally cone-shaped nozzle 32 included in base 30 of fluid-dispensing closure 12 by a mover 91 included in sleeve former 90. A third assembly step is shown in FIG. 9 in which heat is applied to the top part 17U of tubular closure-mount sleeve 18 by a heater 92 included in sleeve former 90 after an inner surface 18I of the top part 17U mates with the exterior surface 82 of lower portion 32L of the generally cone-shaped nozzle 32 to fluidize an annular tip 18T of tubular closure-mount sleeve 18. As suggested in FIG. 10, the fluidized annular tip 18T of tubular closure-mount sleeve 18 has solidified and been mated with the exposed annular lip 81 provided in middle portion 32M of cone-shaped nozzle 32 of base 30 of fluid-dispensing closure 12 to cause the outer surface 18O of tubular closure-mount sleeve 18 to mate and merge in smooth alignment with exterior surface 12E of upper portion 32U of the generally cone-shaped nozzle 32 of base 30 of fluid-dispensing closure 12 as suggested in greater detail in FIG. 12.

Figure 10:
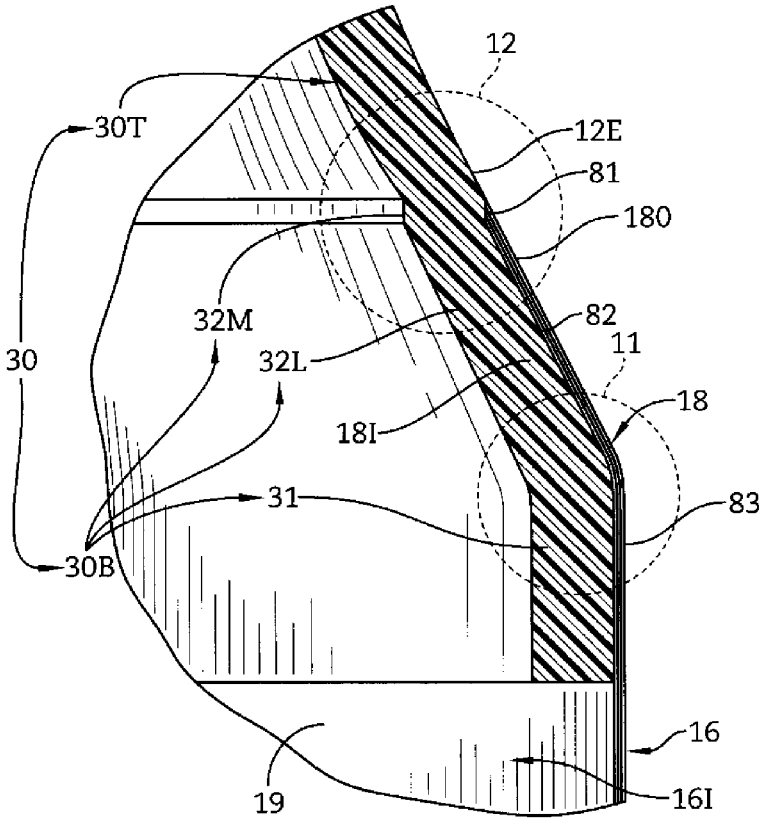
FIG. 10 is a view similar to FIGS. 7-9 showing that the fluidized annular tip of the tubular closure-mount sleeve has solidified and been mated with the exposed annular lip provided in the middle portion of the generally cone-shaped nozzle of the fluid-dispensing closure to cause the outer surface of the tubular closure-mount sleeve to mate and merge in smooth alignment with the exterior surface of the upper portion of the generally cone-shaped nozzle of the base of the fluid-dispensing closure as suggested in greater detail in FIG. 12.
Figure 12:
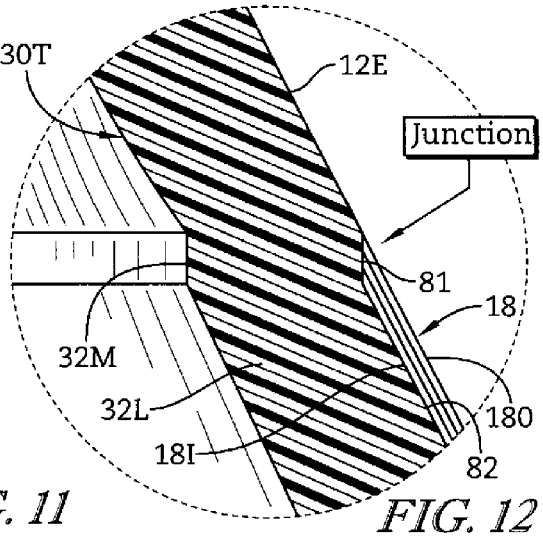
FIG. 12 is an enlarged sectional view of a portion of the squeeze tube taken from a second circled region of FIG. 10 showing that the annular tip included in the tubular closure-mount sleeve is arranged to interconnect the inner and outer surfaces of the tubular closure-mount sleeve and mate with the exposed annular tip to cause the outer surface of the tubular closure-mount sleeve to mate and merge in smooth alignment with the exterior surface of the generally cone-shaped nozzle to provide a substantially smooth and continuous outside wall of the squeeze tube around a circumference of the squeeze tube at the junction between the fluid-dispensing closure and the upper end of the squeezable fluid-storage container as suggested in FIGS. 1-3.

An enlarged sectional view of a portion of the squeeze tube 10 is provided in FIG. 12 and taken from a second circled region of FIG. 10 showing that the annular tip 18T included in tubular closure-mount sleeve 18 is arranged to interconnect the inner and outer surfaces 18I, 18O of tubular closure-mount sleeve 18. Annular tip 18T is arranged to mate with the exposed annular tip 81 to cause the outer surface 18O of the tubular closure-mount sleeve 18 to mate and merge in smooth alignment with the exterior surface 12E of the generally cone-shaped nozzle 32 to provide a substantially smooth and continuous outside wall of squeeze tube 10 around a circumference of the squeeze tube 10 at the annular junction 20 between fluid-dispensing closure 12 and tubular closure-mount sleeve 18 of the squeezable fluid-storage container 16 as suggested in FIGS. 1-3.

The invention claimed is:

1. A squeeze tube comprises a squeezable fluid-storage container and a fluid-dispensing closure coupled to an upper end of the fluid-storage container and configured to control discharge of fluid stored in an interior region of the squeezable fluid-storage container through a discharge aperture formed in the fluid-dispensing closure, wherein the fluid-dispensing closure includes a ring located inside the interior region of the squeezable fluid-storage container, a fluid-discharge deck located outside the interior region of the squeezable fluid-storage container and formed to include the discharge aperture, and a generally cone-shaped nozzle including an upper portion coupled to the fluid-discharge deck and located outside of the interior region of the squeezable fluid-storage container, a lower portion coupled to the ring and located inside the interior region of the squeezable fluid-storage container, the upper portion and the lower portion are substantially coplanar, and a middle portion interposed between and coupled to each of the upper and lower portions and formed to include an exposed annular lip arranged to lie between exterior surfaces of the upper and lower portions, and wherein the upper end of the fluid-storage container includes a tubular closure-mount sleeve including an inner surface arranged to mate with exterior surfaces of the lower portion of the generally cone-shaped nozzle and the ring, an outer surface arranged to face away from the exterior surface of the lower portion of the generally cone-shaped nozzle, and an annular lip arranged to interconnect the inner and outer surfaces of the tubular closure-mount sleeve and cooperate with an exterior surface of the lower portion of the generally cone-shaped nozzle to form an obtuse included angle therebetween and mate with the exposed annular lip to cause the outer surface of the tubular closure-mount sleeve to mate and merge in smooth alignment with an exterior surface of the upper portion of the generally cone-shaped nozzle to provide a substantially smooth and continuous outside wall of the squeeze tube around a circumference of the squeeze tube at a junction between the fluid-dispensing closure and the upper end of the squeezable fluid-storage container.

2. The squeeze tube of claim 1, wherein the squeezable fluid-storage container further includes a receptacle formed to define part of the interior region of the squeezable fluid-storage container and the receptacle is coupled to the tubular closure-mount sleeve to depend therefrom without providing any visible outer gap between an exterior surface of the ring of the fluid-dispensing closure and an outer surface of the squeezable fluid-storage container.

3. The squeeze tube of claim 2, wherein the outer surfaces of the tubular closure-mount sleeve and the receptacle cooperate to define an uninterrupted skin devoid of visible gaps therebetween.

4. The squeeze tube of claim 3, wherein a single tubular band is formed to define the tubular closure-mount sleeve and the receptacle.

5. The squeeze tube of claim 2, wherein a singular tubular band is formed to define the tubular closure-mount sleeve and the receptacle and the singular tubular band includes an upper section arranged to mate with the exposed annular lip and the exterior surface of the lower portion of the generally cone-shaped nozzle, a middle section arranged to mate with the exterior surface of the ring, and a lower section arranged to extend downwardly away from the ring, the upper section is substantially cone-shaped, and the middle section is substantially cylinder-shaped.

6. The squeeze tube of claim 5, wherein the outer surfaces of the upper and middle sections of the singular tubular band cooperate to define an obtuse included angle therebetween.

7. The squeeze tube of claim 5, wherein the exterior surface of the upper portion of the generally cone-shaped nozzle of the fluid-dispensing closure cooperates with the outer surfaces of the upper, middle, and lower sections of the single tubular band to provide a substantially smooth and continuous outside wall of the squeeze tube around the circumference of the squeeze tube at the junction between the fluid-dispensing closure and the squeezable fluid-storage container.

8. The squeeze tube of claim 2, wherein the tubular closure-mount sleeve includes a top part having an end surface arranged to mate with the exposed annular lip of the generally cone-shaped nozzle and an inner surface arranged to mate with the upper portion of the generally cone-shaped nozzle and a bottom part having an inner surface arranged to mate with the lower portion of the generally cone-shaped nozzle and the top and bottom parts of the tubular closure-mount sleeve cooperate to define an obtuse included angle therebetween.

9. The squeeze tube of claim 8, wherein a singular tubular band is formed to define the tubular closure-mount sleeve and the receptacle and the singular tubular band includes an upper section arranged to mate with the exterior surface of the lower portion of the generally cone-shaped nozzle, a middle section arranged to mate with the exterior surface of the ring, and a lower section arranged to extend downwardly away from the ring, and the outer surfaces of the upper and middle sections of the singular tubular band cooperate to define an obtuse included angle therebetween.

10. A squeeze tube comprises a squeezable fluid-storage container and a fluid-dispensing closure coupled to an upper end of the fluid-storage container and configured to control discharge of fluid stored in an interior region of the squeezable fluid-storage container through a discharge aperture formed in the fluid-dispensing closure, wherein the fluid-dispensing closure includes a ring located inside the interior region of the squeezable fluid-storage container, a fluid-discharge deck located outside the interior region of the squeezable fluid-storage container and formed to include the discharge aperture, and a generally cone-shaped nozzle including an upper portion coupled to the fluid-discharge deck and located outside of the interior region of the squeezable fluid-storage container, a lower portion coupled to the ring and located inside the interior region of the squeezable fluid-storage container, the upper portion and the lower portion are substantially coplanar, and a middle portion interposed between and coupled to each of the upper and lower portions and formed to include an exposed annular lip arranged to lie between exterior surfaces of the upper and lower portions, wherein the upper end of the fluid-storage container includes a tubular closure-mount sleeve including an inner surface arranged to mate with exterior surfaces of the lower portion of the generally cone-shaped nozzle and the ring, an outer surface arranged to face away from the exterior surface of the lower portion of the generally cone-shaped nozzle, and an annular tip arranged to interconnect the inner and outer surfaces of the tubular closure-mount sleeve and cooperate with an exterior surface of the lower portion of the generally cone-shaped nozzle to form an obtuse included angle therebetween and mate with the exposed annular lip to cause the outer surface of the tubular closure-mount sleeve to mate and merge in smooth alignment with an exterior surface of the upper portion of the generally cone-shaped nozzle to provide a substantially smooth and continuous outside wall of the squeeze tube around a circumference of the squeeze tube at a junction between the fluid-dispensing closure and the upper end of the squeezable fluid-storage container, and wherein the tubular closure-mount sleeve of the fluid-storage container comprises a multi-layer sheet including an inner tubular layer, an outer tubular layer, and a middle tubular layer interposed between and coupled to the inner and outer tubular layers, the inner tubular layer includes the inner surface that is arranged to mate with the exterior surfaces of the ring and the lower portion of the generally cone-shaped nozzle of the fluid-dispensing closure, and the outer tubular layer includes the outer surface that is arranged to mate and merge in smooth alignment with the exterior surface of the upper portion of the generally cone-shaped nozzle of the fluid-dispensing closure.

11. The squeeze tube of claim 10, wherein exposed ends of each of inner, middle, and outer tubular layers of the tubular closure-mount sleeve cooperate to define the tip of the tubular closure-mount sleeve and mate with the exposed annular lip of the fluid-storage container.

12. The squeeze tube of claim 11, wherein each of the exposed ends of the inner, middle, and outer tubular layers has a frustoconical shape when mated with the exposed annular lip.

13. A squeeze tube comprising a fluid-dispensing closure including a base formed to include a discharge aperture and a fluid-storage container including a receptacle and a tubular closure-mount sleeve coupled to an upper end of the receptacle to form an interior region of the fluid-storage container, wherein the tubular closure-mount sleeve is coupled to and arranged to surround only a bottom rim of the base to leave a deck included in the base and formed to include the discharge aperture and a top rim of the base arranged to interconnect the bottom rim and the deck in a position located above the fluid-storage container and outside of the interior region formed in the fluid-storage container, wherein an outer surface of the tubular closure-mount sleeve is arranged to mate and merge in smooth alignment with an exterior surface of the top rim of the base while an inner surface of the tubular closure-mount mates with the bottom rim of the base to provide a substantially smooth and continuous outside wall of the squeeze tube around a circumference of the squeeze tube at a junction between the fluid-dispensing closure and the tubular closure-mount of the fluid-storage container, the bottom rim of the base includes an annular section that is substantially coplanar with the top rim of the base, and wherein the bottom rim of the base further includes an annular lip coupled to the exterior surface of the top rim of the base at an annular line alongside the junction between the fluid-dispensing closure and the tubular closure-mount of the fluid-storage container and arranged to cooperate with an exterior surface of the bottom rim to form an obtuse included angle therebetween and tubular closure-mount sleeve includes an annular tip arranged to interconnect outer and inner surfaces of the tubular closure-mount sleeve and to mate with the annular lip of the base at the junction.

14. The squeeze tube of claim 13, wherein the top rim of the base has a frustoconical shape.

15. The squeeze tube of claim 14, wherein the outer surface of the tubular closure-mount sleeve includes an upper section arranged to lie alongside the exterior surface of the top rim of the base and formed to have a frustoconical shape, the frustoconical exterior surface of the top rim of the base is characterized by a first slope, and the frustoconical upper section of the outer surface of the tubular closure-mount sleeve is characterized by the first slope.

16. The squeeze tube of claim 15, wherein the outer surface of the tubular closure-mount sleeve includes a lower section that is interposed between and coupled to the receptacle and to the frustoconical upper section of the outer surface of the tubular closure-mount sleeve and the lower section of the outer surface of the tubular closure-mount sleeve is cylinder-shaped.

17. The squeeze tube of claim 15, wherein the bottom rim of the base includes a ring and a collar interposed between and coupled to each of the top rim and the bottom rim, the collar has a frustoconical shape, the ring is cylinder-shaped, an the inner surface of the tubular closure-mount sleeve includes an upper section arranged to mate with the frustoconical collar and a lower section arranged to mate with the cylinder-shaped ring.

18. The squeeze tube of claim 17, wherein the bottom rim of the base includes a ring and a necked-down collar having a narrow end coupled to the annular lip and a relatively wider wide end coupled to the ring and the inner surface of the tubular closure-mount sleeve includes an upper section arranged to mate with an exterior surface of the necked-down collar and a lower section arranged to mate with an exterior surface of the ring.

19. The squeeze tube of claim 18, wherein the exterior surface of the necked-down collar has a frustoconical shape and the exterior surface of the ring is cylinder-shaped.

20. The squeeze tube of claim 17, wherein the annular lip of the base has a frustoconical shape.

21. The squeeze tube of claim 13, wherein each of the outer surface of the tubular closure-mount sleeve and the exterior surface of the top rim of the base has a frustoconical shape.

22. The squeeze tube of claim 21, wherein the bottom rim of the base includes a ring and a collar interposed between and coupled to each of the top rim and the bottom rim, the collar has a frustoconical shape, the ring is cylinder-shaped, an the inner surface of the tubular closure-mount sleeve includes an upper section arranged to mate with the frustoconical collar and a lower section arranged to mate with the cylinder-shaped ring.

* * * * *